US006569546B1

(12) United States Patent
Sato et al.

(10) Patent No.: US 6,569,546 B1
(45) Date of Patent: May 27, 2003

(54) MEMBER WITH FILM FORMED BY THERMAL SPRAYING OF THERMAL SPRAY MATERIAL

(75) Inventors: Takao Sato, Tokyo (JP); Kiyohiro Tarumi, Tokyo (JP); Yuusei Michikata, Tokyo (JP); Yoshihisa Horie, Tokyo (JP); Junichi Yasuoka, Gunma (JP)

(73) Assignee: Nippon Steel Hardfacing Co., Ltd., Tokyo (JP)

( * ) Notice: Subject to any disclaimer, the term of this patent is extended or adjusted under 35 U.S.C. 154(b) by 0 days.

(21) Appl. No.: 09/530,101

(22) PCT Filed: Sep. 9, 1999

(86) PCT No.: PCT/JP99/04900

§ 371 (c)(1),
(2), (4) Date: Jul. 3, 2000

(87) PCT Pub. No.: WO00/15861

PCT Pub. Date: Mar. 23, 2000

(30) Foreign Application Priority Data

Sep. 10, 1998 (JP) ..... 10-272487

(51) Int. Cl.[7] ..... B32B 18/00; C09D 5/46
(52) U.S. Cl. ..... 428/697; 106/286.2
(58) Field of Search ..... 106/286.2; 428/697

(56) References Cited

U.S. PATENT DOCUMENTS 4,173,518 A * 11/1979 Yamada et al. ..... 204/67
4,542,111 A * 9/1985 Buran et al. ..... 501/127
6,284,320 B1 * 9/2001 Tarumi et al. ..... 427/376.2

FOREIGN PATENT DOCUMENTS

JP 59-107080 6/1984
JP 61-250161 11/1986
JP 62-139286 6/1987

OTHER PUBLICATIONS

CA PLUS AN 1990:643432, Klngsley et al, "Combustion synthesis of fine particle . . . " 1990.*

* cited by examiner

*Primary Examiner*—David Brunsman
(74) *Attorney, Agent, or Firm*—Kanesaka & Takeuchi

(57) ABSTRACT

A member having a coating film is formed by thermal spraying a thermal spray material. The thermal spray material includes a double oxide forming a monophasic oxide, and contains (a) at least one trivalent metal element selected from the group consisting of Al, Ti, V, Cr, Co, Rh, and Sc, Y and lanthanoid in rare earth elements, and (b) at least one element selected from the group consisting of Sc, Y, and lanthanoid in the rare earth elements different from those in (a).

2 Claims, 1 Drawing Sheet

MEMBER WITH FILM FORMED BY THERMAL SPRAYING OF THERMAL SPRAY MATERIAL

This application is a 371 of PCT/JP99/03900 filed Sep. 9, 1999.

FIELD OF THE INVENTION

The present invention relates to a member with a film formed by a thermal spray material for applying special properties which is thermally sprayed onto products, equipments, members, and the like which are manufactured or employed in various fields, such as steel making, ship building, paper making, automobile manufacture, household appliance manufacture, office equipment manufacture, construction, and the like, which require molten metal corrosion resistance, molten salt corrosion resistance, resistance to oxidation, resistance to thermal shock, resistance to build-up, chemical resistance, salt water resistance, and the like.

BACKGROUND ART

Conventionally, ceramic was thermally sprayed onto a portion of structural members in the various fields described above; however, it cannot be said that the members employed had thermal spraying over the entire surface thereof.

The reason for this was that, although ceramic is superior in the desired corrosion resistance, resistance to high temperature oxidation, and resistance to build-up with metals and the like, it is not clearly superior to cermet, and furthermore, there are problems with the strength, minuteness, adhesion, and resistance to thermal shock of the coating, so that it was difficult to actually apply.

Representative conventional ceramic thermal spray materials included, for example, $Al_2O_3$, $Cr_2O_3$, $MgAl_2O_4$, $Al_2O_3$+$TiO_2$, and the like.

In the conventional materials described above, the conventional materials described above were unsatisfactory in that they either did not exhibit sufficient properties, or had desirable properties but also had defects. For example, $Al_2O_3$ and $Cr_2O_3$, which are known as the most common ceramics, had the following problems.

$Al_2O_3$: this substance itself has good oxidation resistance and resistance to chemicals; however, a large number of cracks is formed in the coating film which is formed, and gas and solutions and the like penetrate along these cracks and erode the material, so that peeling of coating film is caused. As a result, there is no oxidation resistance or resistance to chemicals.

$Cr_2O_3$: the problem is the same as $Al_2O_3$; in particular, in molten zinc baths and the like containing Al, as the concentration of Al increases, $Cr_2O_3$ is reduced by Al, so that the layer itself is eroded.

Furthermore, as a defect which is essentially common to these, the thermal spraying efficiency is low.

In order to eliminate these deficiencies, in Japanese Patent Application No. HEI 9-122904, the combination of various oxides containing rare earths is disclosed. Additionally, in Japanese Patent Application, first publication No. HEI 4-350154, the addition of $SiO_2$ to other oxides and an improvement in the resistance to thermal shock is disclosed. However, these proposals only involve the simple combination of various oxides, so that while the advantages of one oxide are present, the disadvantages of another oxide are simultaneously present, so that, although there is some effect, it was unsatisfactory.

The present invention solves the problems present in the prior art described above, and has as an object thereof to provide a thermal spray material capable of forming a coating film satisfying all characteristics, and members having a coating film formed using this thermal spray material.

DISCLOSURE OF THE INVENTION

As a result of diligent investigations with the object of attaining the object described above, the present inventors have discovered that a coating film having as a chief component thereof a double oxide of rare earths or a double oxide containing rare earths is superior in all required characteristics and have thus arrived at the present invention.

The present invention, which is based on the discovery described above, has as an essential point thereof, a thermal spray material which contains one or more double oxides comprising (a) one or more of the trivalent metal elements Al, Ti, V, Cr, Co, Rh, and rare earth (Sc, Y, and lanthanoid), and (b) one or more rare earth (Sc, Y, and lanthanoid) differing from those in (a).

Furthermore, a thermal spray material in which the amount of the double oxide described above contained is 5% by volume or more, the remainder comprising one or more metal oxides, excluding the Group Ia metals, or oxides of Si, is also an essential point of this present invention.

Furthermore, a member having a coating film formed by the thermal spray material described above is also an essential point of the present invention.

The structure and function of the present invention will now be explained.

The double oxide of the thermal spray material structural component of the present invention is a monophasic oxide comprising a plurality of object structural metals, and is a phase differing from all the oxides of the simple substances of the structural metal elements. In many cases, the double oxide employed in the present invention is one which has a crystalline structure differing from the oxide from each structural metal simple substance (crystalline structures such as ilmenite structures, perovskite structures, and garnet structures and the like); however, there are many for which the structure is not known (particularly in the case of multi-element systems), and there are many which are not listed in JCPDS (Joint Committee on Powder Diffraction Standards: published by International Center for Diffraction Data).

The thermal spray material of the present invention contains the double oxides as defined above. With respect to this point, the concept is different from the simple combination of oxides in the invention of Japanese Patent Application No HEI 9-122904 discussed above.

Oxides, hydroxides, carbonates, and chlorides of organic acids may be employed as the double oxide structural raw material of the thermal spray material structural component of the present invention. The following manufacturing methods may be adopted:

a. A method in which the predetermined raw materials are mixed, and are melted in an arc furnace or the like, and are then pulverized and classified.
b. A method in which the raw materials are first mixed, then molded, sintered, pulverized, and classified.
c. A method in which the raw materials are mixed, and then the mixture is granularized, sintered, pulverized, and classified.

d. A method in which microgranules of the double oxide produced by the sol-gel method are granularized, sintered, pulverized and classified.

e. A method in which one or two or more types of double oxides produced by the methods of a–d above are granularized (and furthermore, where necessary, these may be sintered, pulverized, and classified). However, the material of the present invention is not limited to these manufacturing methods.

The grain size of the double oxide after pulverization and classification may be determined by the thermal sprayer which is employed; however, this is roughly within a range of 500–5 micrometers.

Furthermore, in the present invention, the double oxides described above can be used by themselves as thermal spray materials; however, as a result of the adjustment of the thermal expansion with the substrate, or for economic reasons, depending on the use, it is preferable to thermally spray a thermal spray material containing these double oxides in an amount of at least 5% by volume, the remainder comprising one or more of metal oxides excluding the Group Ia metals or oxides of Si. When the double oxide is contained in an amount of less than 5% by volume, the effects thereof can not be expected. It is also possible to mix these oxides; however, a complex, in which one oxide is distributed within another oxide, is more preferable.

Furthermore, depending on the use, in order to reduce residual stress within the coating film, a bond coat of a hot corrosion resistant alloy such Ni—Cr, Co—Cr, Co—Cr—Mo, MCr—Al—Y, or the like, or a cermet material having a certain degree of corrosion resistance to molten metals comprising WC—Co, WB—WC—Co, or like, may be employed, and this does not limit the present invention.

The thickness of the coating film is preferably within a range of 5–1000 micrometers depending on the use; however, a range of 10–500 micrometers is preferable for the development of the residual stress effect.

Furthermore, a sealing treatment may be executed by impregnating or firing, onto the coating film, a solution having as the chief component thereof one of dichromic acid ($H_2CrO_4$ and/or $H_2Cr_2O_7$), and inorganic colloidal compound, or a metal alkoxide or the like, and these applications do not limit present invention.

DESCRIPTION OF THE REFERENCES

Figure 1:
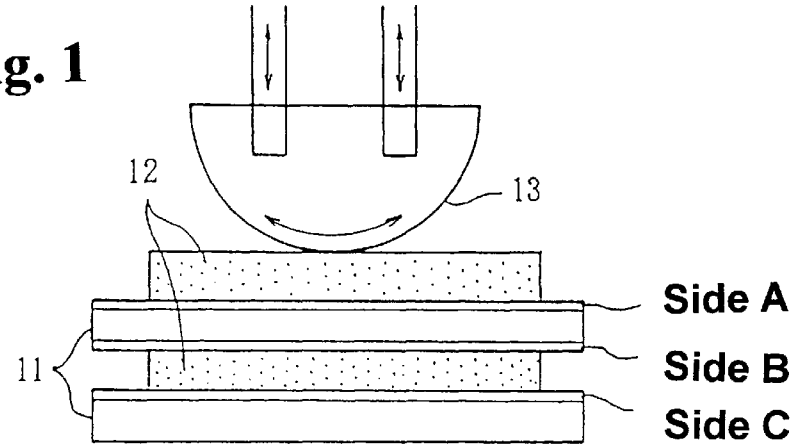
FIG. 1 is a schematic explanatory diagram of the equipment for testing the resistance to build-up of a test piece on which the thermal spray material of the present invention was thermally sprayed.

11 test piece having coating film formed thereon.
12 build-up raw material
13 half moon roll
21 test piece
22 newspaper
23 pressure roll
24 dead weight
25 excess moisture absorption paper
26 beaker
27 test solution

BEST MODE FOR CARRYING OUT THE INVENTION

The present invention will be concretely explained based on embodiments; however, the present invention is not limited by these embodiments.

The thermal spray materials of manufacturing examples of the double oxides which are components of the thermal spray material of the present invention, and thermal spray materials of conventional examples, will be explained.

STRUCTURAL EXAMPLE 1 (J-1)

10 moles of $Al_2O_3$ and 10 moles of $La_2O_3$ were mixed in a ball mill, and these materials were formed into tablets of 10 mmϕ×5 mmh, and these were baked for four hours at a temperature of 1600° C. in a commonly known oxidizing atmosphere furnace, and pulverization and classification were conducted with commonly known machinery to obtain a powder of −45+10 micrometers (less than or equal to 45 micrometers and greater than or equal to 10 micrometers). When this powder was analyzed by X-ray diffraction, no peaks were observed other than at $LaAlO_3$.

STRUCTURAL EXAMPLE 2 (J-2)

A powder was obtained, by a method similar to that of manufacturing example 1, from 10 moles of $Cr_2O_3$ and 10 moles of $Y_2O_3$. When this powder was analyzed by X-ray diffraction, no peak was observed other than that of $CrYO_3$.

STRUCTURAL EXAMPLE 3 (J-3)

A powder was obtained, by a method similar to that of manufacturing example 1, from 20 moles of $Cr_2O_3$ and 10 moles of $Y_2O_3$. When this powder was analyzed by X-ray diffraction, no peaks were observed other than those of $CrYO_3$ and $Cr_2O_3$. When the surface area ratio of $CrYO_3$ was measured, and the volumetric ratio thereof was determined, from image analysis of a reflected electron composite image of the cross section of a coating film obtained by plasma thermal spraying of this powder, $CrYO_3$ was 13 vol %.

STRUCTURAL EXAMPLE 4 (J-4)

When the surface area ratio of $CrYO_3$ was measured, and the volumetric ratio thereof was obtained, from the image analysis of a reflected electron composite image of a cross section of a coating film obtained by the plasma thermal spraying of a powder comprising a mixture of 15 vol % of the powder produced in manufacturing example 2 and 85 vol % of a commercially available $Cr_2O_3$ thermal spraying material, it was determined that $CrYO_3$ was 14 vol %.

STRUCTURAL EXAMPLE 5 (J-5)

10 moles of $Ce_2(Co_3)_3.2H_2O$ and 10 moles of $Al_2O_3$ were mixed in a ball mill, these were formed into tablets of 10 mmΦ×5 mmh, and after conducting calcination for two hours at 1200° C. in a commonly known oxidizing atmosphere furnace in order to remove $CO_2$ and $H_2O$, baking was conducted for four hours at 1600° C. in a commonly known oxidizing atmosphere furnace, and this was then pulverized and classified using conventionally known machinery to obtain a −45+10 micrometer powder. When this powder was analyzed by X-ray diffraction, no peak was observed other than that of $CeAlO_3$.

STRUCTURAL EXAMPLE 6 (J-6)

50 vol % of the powder produced in manufacturing example 2 and 50 vol % of the powder produced in manufacturing example 5 were mixed in a ball mill and finely pulverized to obtain a micropowder having an average particle diameter of 1 micrometer. After granulating this micropowder in a spray dryer, sintering, pulverization, and classification were conducted to obtain a −45+10 micrometer powder.

STRUCTURAL EXAMPLE 7 (J-7)

A thermal spray material of the double oxide produced in manufacturing example 5 and a commercially available spray material (a powder with a grain size of −45+10 micrometers) of partially stabilized $ZrO_2$ having 8 wt % $Y_2O_3$ in solid solution (hereinbelow referred to as 8YSZ) were mixed at a volumetric ratio of 3:7.

STRUCTURAL EXAMPLE 8 (J-8)

The thermal spray material of the double oxide produced in manufacturing example 5, and a commercially available $Al_2O_3$−40 wt % $TiO_2$ thermal spray material (a powder with a grain size of −45+10 micrometers) were mixed at a volumetric ratio of 3:1.

BOND COAT EXAMPLE 1 (B-1)

WC-30%WB-12%Co was thermally sprayed as a gas at high speed as a bond coat.

BOND COAT EXAMPLE 2 (B-2)

Commercially available CoNiCrAlY (Ni:32%, Cr:21%, Al:8%, Y:0.5%, Co: balance) was thermally sprayed as a gas at high speed as a bond coat.

SEALING TREATMENT EXAMPLE 1 (F-1)

An aqueous solution in which the chief component was 6% dichromic acid was impregnated into the coating film, and then heat treatment was conducted at 450° C. for one hour, and sealing was thus conducted.

SEALING TREATMENT EXAMPLE 2 (F-2)

A 10% alcohol solution having alkoxysilane-system $SiO_2$ as a chief component was impregnated into the coating film, and heat treatment was conducted for one hour at 180° C., and sealing was thus carried out.

COMPARATIVE EXAMPLE 1 (H-1)

A commercially available thermal spray material of WC-12 wt %Co.

COMPARATIVE EXAMPLE 2 (H-2)

A thermal spray material which is commercially available comprising partially stabilized $ZrO_2$ containing 8 wt % $Y_2O_3$.

COMPARATIVE EXAMPLE 3 (H-3)

A powder was produced using a method similar to that of manufacturing example 1 from 22 moles of $Cr_2O_3$ and 0.4 moles of $Y_2O_3$.

When this powder was analyzed using X-ray diffraction, peaks other than those of $CrYO_3$ and $Cr_2O_3$ were not observed. When the surface area ratio of $CrYO_3$ was measured, and the volumetric ratio thereof was obtained from image analysis of reflected electron composite images of the cross section of a coating film resulting from the plasma thermal spraying of this powder, it was found that $CrYO_3$ was 4 vol %.

COMPARATIVE EXAMPLE 4 (H-4)

A commercially available $Cr_2O_3$ thermal spray material.

COMPARATIVE EXAMPLE 5 (H-5)

A commercially available $Al_2O_3$ thermal spray material.

COMPARATIVE EXAMPLE 6 (H-6)

A commercially available $Al_2O_3$-10 wt % $TiO_2$ thermal spray material.

Thermal Spraying Conditions With Respect to the Manufacturing Examples, the Comparative Examples, and the Bond Coat Examples After blast treatment (at an air pressure of 4 kg/cm$^2$) of the substrate using a number 70 alumina grid, a top coat was plasma thermally sprayed, and a bond coat was high speed gas sprayed, and the thermal sprayings were thus carried out.

Plasma thermal spraying (using a 10M thermal sprayer produced by Sulzer Metco (US) Inc.)

| | |
|---|---|
| Gas employed | Ar—$H_2$ |
| Gas flow rate | Ar 24 2.7 m$^3$/h<br>$H_2$ 0.5 m$^3$/h |
| Output | 30 kw (500 A × 60 V) |
| Thermal spraying range | 75–125 mm |
| Amount of powder | 20–50 g/min |

High Speed Gas Thermal Spraying (using a diamond thermal sprayer produced by Through the Meteco, Inc)

| | |
|---|---|
| Combustion gas | Oxygen pressure |
| 10.3 bars | Propylene pressure 6.9 bars<br>Air pressure 5.2 bars |
| Thermal spraying distance | 150–200 mm |
| Thermal spraying powder feed rate | 38 g/min |

EMBODIMENT 1

Preparation of the Test Pieces

Coating films in accordance with the manufacturing examples of the present invention and in accordance with comparative examples were formed on a substrate (material: SUS31L, dimensions: 30 mm×300×5 mmt), and test pieces were thus produced for assessing leakage and reactivity with respect to molten metals. In this case, the thickness of both the top coat and the bond coat was 50 micrometers.

The results of an assessment of the reactivity and leakage with respect to molten metals of the coating films formed by thermal spraying the thermal spray materials of the various manufacturing examples and comparative examples onto the test pieces are shown in Table 1.

TABLE 1

| Classification | No. | Coating Film Composition (vol %) | Bond Coat | Sealing Treatment | Leakage Test (days) 10 | 30 | 60 |
|---|---|---|---|---|---|---|---|
| Present Invention | 1 | $LaAlO_3$ (J-1) | — | — | Θ | ○ | Δ |
| | 2 | $LaAlO_3$ (J-1) | B-1 | — | Θ | ○ | Δ |
| | 3 | $LaAlO_3$ (J-1) | — | F-1 | Θ | Θ | ○ |
| | 4 | $YCrO_3$ (J-2) | B-1 | F-1 | Θ | Θ | Θ |
| | 5 | $YCrO_3$ (J-2) | B-1 | — | Θ | ○ | Δ |
| | 6 | $YCrO_3$ (J-2) | — | F-1 | Θ | Θ | ○ |
| | 7 | $Cr_2O_3$—13$YCrO_3$ (J-3) | B-1 | F-1 | Θ | Θ | ○ |
| | 8 | $Cr_2O_3$— | B-1 | F-1 | Θ | Θ | Δ |

TABLE 1-continued

| Classification | No. | Coating Film Composition (vol %) | Bond Coat | Sealing Treatment | Leakage Test (days) 10 | 30 | 60 |
|---|---|---|---|---|---|---|---|
| | | $15YCrO_3$ (granular) (J-4) | | | | | |
| | 9 | $CeAlO_3$ (J-5) | B-1 | F-1 | Θ | Θ | Θ |
| | 10 | $YCrO_3$—$50CeAlO_3$ (J-6) | B-1 | F-1 | Θ | Θ | Θ |
| Comparative Example | 11 | WC-12 wt % Co (H-1) | — | F-1 | ○ | Δ | X |
| | 12 | 8YSZ (H-2) | — | F-1 | ○ | X | X |
| | 13 | $Cr_2O_3$—$4YCrO_3$ (H-3) | B-1 | F-1 | Θ | ○ | X |
| | 14 | $Cr_2O_3$ (H-4) | B-1 | F-1 | Θ | ○ | X |
| | 15 | $Cr_2O_3$ (H-4) | B-1 | — | ○ | Δ | X |
| | 16 | $Cr_2O_3$(H-4) | — | F-1 | ○ | X | X |

Note:
Leakage test: Extraction and comparison after immersion in a molten zinc bath at 400° C.
Evaluation:
Θ No zinc deposited
○ Zinc deposited in places, but easily removed
Δ Film partially peeled or zinc deposited in places and not easily removed
X Zinc deposited over entire surface of film or large amount of peeling In Table 1, numbers 1 through 10 indicate examples of the present invention, while numbers 11 through 16 indicate comparative examples.

When the pieces were removed after immersion for 10 days, 30 days, and 60 days in a molten zinc bath at 460° C., and the leakage and reactivity were compared, all of the coating films of the present invention were in a good state when compared to the conventional examples in accordance with the conventional technology under similar conditions, even after immersion for 60 days. Among the conventional examples, numbers 13 and 14, which correspond to an earlier invention, showed good results.

It is clear from these results that the coating film formed by the double oxide thermal spray material of the present invention is superior in resistance to peeling and in corrosion resistance with respect to molten metals.

In the embodiments described above, the effects were resulted from the applications to a molten zinc plating bath; however, similar results are obtainable in the applications to molten aluminum plating bath or molten zinc-50% aluminum plating bath, and thus the effects of the present invention are confirmed.

EMBODIMENT 2

Assessment of characteristics as a roll within a heat treatment furnace for continuous annealing of thin steel plate As a test piece for assessing resistance to build up, coating films were formed on SUS304 substrates (50 mm×30 mm×5 mmt) using a thermal spray method similar to that of embodiment 1, and employing the thermal spray materials of the various manufacturing examples and conventional examples, and a top coat layer of 50 micrometers and a bond coat layer of 60 micrometers were executed. These test pieces were evaluated for resistance to build-up using the apparatus shown in FIG. 1.

In the testing, under the conditions shown below, a build-up raw material 12 was dispersed between two coated test pieces 11 (between the B surface and the C surface), and on the upper surface (A surface) of the upper test piece, as shown in FIG. 1, and reciprocal motion was conducted while applying a load using half moon roll 3, and the state of build-up on each of the surfaces A, B, and C was evaluated. The results of the evaluation are shown in Table 2.

| Build-up Test Conditions | |
|---|---|
| Temperature | 850° C. |
| Atmosphere | $N_2$-5% $H_2$ |
| Load | 8.5 kg |
| Build-up raw material | $Fe_3O_4$ powder |
| Test period | 4 hours |

The evaluation was conducted using a total number of points (with 9 points being the highest mark) for the surfaces A, B, and C using points obtained in accordance with the standards shown below.

Build-up Evaluation Points (MN Values)

| Score | Build-up State |
|---|---|
| 3 | When turned on its side, the build-up raw material falls off. |
| 2 | When rubbed with gauze, the build-up raw material falls off. |
| 1 | When rubbed with a pinset, the build-up raw material falls off. |
| 0 | The build-up raw material does not fall off using the methods described above. |

TABLE 2

| Classification | No. | Coating Film Composition (vol %) | Bond Coat | Sealing Treatment | MN Value |
|---|---|---|---|---|---|
| Present invention | 1 | $LaAlO_3$ (J-1) | B-2 | F-1 | 7.5 |
| | 2 | $LaAlO_3$ (J-1) | B-2 | — | 7.0 |
| | 3 | $YCrO_3$ (J-2) | B-2 | — | 8.0 |
| | 4 | $YCrO_3$ (J-2) | — | — | 8.0 |
| | 5 | $CeAlO_3$ (J-5) | B-2 | — | 7.5 |
| | 6 | $CeAlO_3$ (J-5) | — | — | 7.5 |
| | 7 | $YCrO_3$-$50CeAlO_3$ (J-6) | B-2 | — | 8.0 |
| | 8 | $CeAlO_3$-70(8YSZ) (J-7) | B-2 | — | 7.0 |
| Comparative Examples | 9 | 8YSZ (H-2) | B-2 | F-1 | 4.0 |
| | 10 | 8YSZ (H-2) | B-2 | — | 2.0 |
| | 11 | $Cr_2O_3$ (H-4) | B-2 | — | 4.0 |
| | 12 | $Al_2O_3$ (H-5) | B-2 | — | 5.5 |

In Table 2, numbers 1 through 8 indicate examples of the present invention, while numbers 9 through 12 indicate comparative examples.

As a result of the simulation test which investigated the build-up characteristics of iron components onto a roll in a heat treating furnace, it was learned that the coating films in accordance with the present invention all had MN values of 7 or more, and in comparison with the conventional examples, they exhibited dramatically better resistance to build-up.

EMBODIMENT 3

Investigation with respect to corrosion resistance with respect to acidic aqueous solutions such as dilute sulfuric acid and the like.

Coating films were formed on test pieces [SUS304 substrates (50 mm×30mm×5 mmt)] having the same dimensions as in embodiment 2, having a thermal spray method similar to that of embodiment 1 and employing thermal spray materials of each of the manufacturing examples and comparative examples, and the thickness of the top coat layer was 30 micrometers, while the thickness of the bond coat layer was 60 micrometers. These test pieces were immersed in a 10% sulfuric acid solution, and were compared by means of the number of days required until the peeling of the coating film. The results thereof are shown in Table 3.

TABLE 3

| Classification | No. | Coating Film Composition (vol %) | Bond Coat | Number of Days Until Peeling of Coating Film |
|---|---|---|---|---|
| Present Invention | 1 | $YCrO_3$ (J-2) | B-1 | 32 |
| | 2 | $YCrO_3$ (J-2) | — | 20 |
| | 3 | $Cr_2O_3$-13$YCrO_3$ (J-3) | B-1 | 12 |
| | 4 | $CeAlO_3$ (J-5) | B-1 | 20 |
| | 5 | $YCrO_3$-50$CeAlO_3$ (J-6) | B-1 | 25 |
| Comparative Examples | 6 | $Cr_2O_3$ (H-4) | B-1 | 7 |
| | 7 | $Cr_2O_3$ (H-4) | — | 3 |
| | 8 | $Cr_2O_3$-4$YCrO_3$ (H-3) | B-1 | 7 |
| | 9 | $Al_2O_3$ (H-5) | B-1 | 4 |

Note: No sealing treatment.

None of the test pieces was subjected to sealing treatment. If sealing treatment is conducted, the number of days until peeling is increased; however, because the evaluation of the resistance to corrosion of the coating film becomes difficult, comparison was conducted without sealing treatment.

In Table 3, numbers 1 through 5 indicate examples of the present invention, while numbers 6 through 9 indicate comparative examples.

The number of cycles from immersion in the 10% sulfuric acid solution until the peeling of the coating film was far longer using the examples of the present invention than with the comparative examples, so that it can be seen that the corrosion resistance is good. This is optimal for use as thermal spray material onto rolls employed in processes employing corrosive liquids.

EMBODIMENT 4

Evaluation of the coating film characteristics for movable members, such as piston rods, jack rams, axles, and valves and the like in hydraulic or air pressure cylinders made of steel Piston rods, jack rams, axles, and valves and other movable members used in steel hydraulic or air pressure cylinders which are used to drive ships, floodgates, construction machinery or movable bridges or the like, are exposed to extremely harsh conditions of use, and are likely to be corroded and abraded. For this reason, processes are conducted with respect to the surfaces of these movable members which have superior characteristics in corrosion resistance and in resistance to abrasion.

In order to evaluate the corrosion resistance, resistance to abrasion, slidability and resistance to peeling when coating films using the thermal spray materials of the present invention are applied to the movable members described above, the following simulation evaluative test is conducted.

Fog Corrosion Test

Coating films were formed on SS400 test substrates (50mm×100 mm×10 mm) using a thermal spray method similar to that of embodiment 1 and employing the thermal spray material of each of the manufacturing examples and comparative examples, and the thickness of the top coat layer was 300 micrometers, while the thickness of the bond coat layer was 50 micrometers.

In the fog corrosion test, in accordance with JIS D 0201 (the CASS test), a corrosive liquid (Sodium chloride (test chemical) was dissolved in distilled water or in ion-exchanged desalinated water so as to be 5±1 wt %. 0.1–0.3% of acetic acid (test chemical) was added to this salt solution, and the solution was adjusted so it had a pH within a range of 3.0–3.1 at 25° C.) was employed, and the test was carried out at a temperature of 50° C. The results thereof are shown in Table 4. The evaluation was conducted in terms of the number of days until the occurrence of rust.

TABLE 4

| Classification | No. | Coating Film Composition (vol %) | Bond Coat | Sealing Treatment | Rust Occurrence Time (h) | Repeated Bending Characteristic (cycles) |
|---|---|---|---|---|---|---|
| Present Invention | 1 | $YCrO_3$ (J-2) | B-2 | F-2 | >1,000 | >10,000 |
| | 2 | $CeAlO_3$ (J-5) | B-2 | F-2 | >1,000 | >10,000 |
| | 3 | $CeAlO_3$-25($Al_2O_3$-40 wt % $TiO_2$) (J-8) | B-2 | F-2 | >1,000 | >10,000 |
| | 4 | $Cr_2O_3$-13$YCrO_3$ (J-3) | B-2 | F-2 | >1,000 | >10,000 |
| Comparative Examples | 5 | $Cr_2O_3$ (H-4) | B-2 | F-2 | 750 | >10,000 |
| | 6 | $Al_2O_3$ (H-5) | B-2 | F-2 | 300 | 7,000 |
| | 7 | $Al_2O_3$-10 wt % $TiO_2$ (H-6) | B-2 | F-2 | 600 | >10,000 |

The coating films formed by means of the present invention were good, in that rust did not occur even after the passage of 1000 hours; however, the occurrence of rust was confirmed in all of the comparative examples.

Furthermore, in order to test the peeling characteristics of the coating film, coating films which were identical to those described above were formed on rods having dimensions of 90 mmϕ×130 mm in accordance with JIS G 4051 S45CH, and a repeated bending test was conducted. In order to approximate the actual state, the coating film was formed so that the bond coat had a thickness of 50 micrometers, and the top coat thereon had a thickness of 300 micrometers.

The test employed a 60 t fatigue tester, and was conducted under the following conditions.

| | |
|---|---|
| Distance between support points: | 1000 mm |
| Amount of bend: | 2 mm |
| Temperature: | room temperature |
| Cycle: | 1 Hz |
| Bending cycles: | 10,000 |
| Judgment criteria: | no cracking or peeling in the coating film |

As shown in Table 4, the rod for testing having a coating film in accordance with the present invention formed thereon exhibited no peeling of the coating film even after receiving 10,000 cycles of repeated bending deformation, and it was thus possible to confirm that it could sufficiently withstand actual use, and was either better than or approximately equal to the comparative ceramic coating films.

The present invention was applied to piston rods of actual hydraulic cylinders and the slidability with the packing material was considered. As a result, the piston rods of hydraulic cylinders having coating films which were thermally sprayed and sealing-treated on a corrosion resistant alloy base layer obtained slidability which was similar to that of the chrome plate which was conventionally employed.

EMBODIMENT 5

Assessment of the Characteristics as a Roll Used in Equipment for Resin Film and Paper Manufacture The releasability of the film and paper (with respect to paper, the adequacy of paper release) which are transported, which is particularly important among the characteristics of a roll employed in the equipment described above, was investigated.

Test pieces [SUS304 substrates (50 mm×30 mm×5 mmt)] were produced under the same conditions as in embodiment 2, and these were adjusted so that the coating film surface roughness was set to an $R_{max}$ of approximately 3.0, and under the condition shown below, a test was executed in accordance with the order shown in FIG. 2.

| Test Conditions | |
|---|---|
| Test object: | newspaper paper |
| Test temperature: | room temperature |
| Test piece pull speed: | 206 mm/min |
| Test order: | FIG. 2 |

Figure 2D:
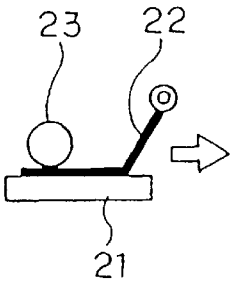
FIGS. 2(*a*)–2(*d*) are explanatory diagrams of the process for evaluating the paper release properties of the coating film of the present invention.
Figure 2C:
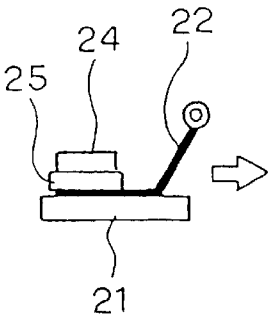
Figure 2B:
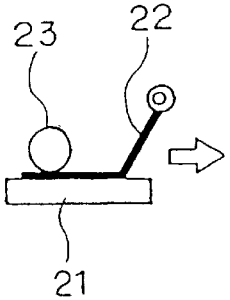
Figure 2A:
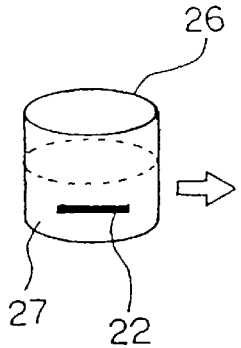

In beaker 26, number 1 used water as the test liquid 27, while number 2 used 10% size employing commercially available office glue as the test liquid 27, and newspaper 22 having the same width as the surface of the test piece 21 (30 mm) was immersed therein (FIG. 2*a*), and using a roll 23 having a load of 225 g/cm thereon, the newspaper 22 immersed in the test liquid 21 was pressed onto the surface of the test piece 21 (FIG. 2*b*). Next, absorbing paper 25 was placed on top of newspaper 22, and applying a weight 24 of, on average, 382 g/cm$^2$, the excess moisture was absorbed (FIG. 2*c*). After this, pressing was again conducted using the roll 23 (FIG. 2*d*), and the newspaper 22 was pulled away from the test piece 21 in an upwards direction.

The results of the test are shown in Table 5. For reference, the test results of chrome plating, which is conventionally employed, are also shown.

These results make clear that the thermal spray material in accordance with the present invention, and the members having a coating film formed thereon using this thermal spray material, have superior paper release characteristics.

TABLE 5

| Classification | No. | Coating Film Composition (vol %) | Bond Coat | Pulling Weight (g) No. 1 | Pulling Weight (g) No. 2 |
|---|---|---|---|---|---|
| Present Invention | 1 | $YCrO_3$ (J-2) | B-2 | 2.9 | 3.5 |
| | 2 | $YCrO_3$ (J-2) | — | 2.9 | 3.5 |
| | 3 | $CeAlO_3$ (J-5) | B-2 | 3.2 | 3.8 |
| | 4 | $Cr_2O_3$-13$YCrO_3$ (J-3) | B-2 | 3.3 | 4.0 |
| Comparative Examples | 5 | $Cr_2O_3$ (H-4) | B-2 | 3.4 | 4.2 |
| | 6 | $Al_2O_3$ (H-5) | B-2 | 4.1 | 4.9 |
| | 7 | Chrome plating | — | 3.8 | 4.7 |

Note 1: No sealing processing.
Note 2:
No. 1; only water No. 2; 10% size (In accordance with the testing order of FIG. 2)

Furthermore, when the corrosion resistance to molten salt, the oxidation resistance, the resistance to thermal shock and the like, were assessed, superior effects were confirmed in all of these areas.

Industrial Applicability

The thermal spray material containing double oxide in accordance with the present invention is provided with the following characteristics, in comparison with the conventional ceramic thermal spray material.

a. When the conventional ceramic is employed, during thermal spraying (including heating, melting, flight, and deposition), there are many cases in which there are changes in the structure and composition and the like of the thermal spray material. For example, the following occurs:

$$\alpha\text{-}Al_2O_3 \rightarrow \beta\text{-}Al_2O_3$$

$$TiO_2\ (\text{rutile}) \rightarrow TiO_{(1-x)}$$

When these phenomena occurs, the characteristics originally possessed by the material can no longer be expected. However, the double oxide employed in the present invention has a crystalline structure which is stable, and before and after the thermal spray process, there are no changes in the structure or composition thereof.

b. The mixture of hydrogen into the work gas in order to increase the enthalpy of the plasma is often conducted; however, even in this reduced atmosphere, the coating film formed by the thermal spray material of the present invention remains ultimately unreduced, and maintains the same structure and composition as the thermal spray material. The reason for this is thought to be that, since the affinity for oxygen of the rare earth elements is extremely high, even if they are reduced at high temperatures by the hydrogen, they bond with oxygen in the environment before deposition as a coating film, and return to the original double oxide. For example, in the case of $Cr_2O_3$, when the work gas is hydrogen, metallic Cr is deposited in the coating film; however, in the case of $YCrO_3$, no metallic Cr is observed.

c. The thermal spray efficiency is extremely high. In general, the thermal spray efficiency of the conventional ceramic thermal spray material is within a range of 20–40%; however, the thermal spray efficiency of the thermal spray material of the present invention is 50% or more, and among these materials, there are some which are in the vicinity of 80%.

As a result of these features, the following superior characteristics are exhibited.

Molten Metal Corrosion Resistance is Good

Leakage is unlikely to occur with respect to molten metals, and reaction with them is unlikely. It is conjectured that the complex oxides with the rare earths contained in the coating film have the property of not being reduced even when they come into contact with active molten metals containing Al or the like.

Molten Salt Corrosion Resistance

The mechanism has not been elucidated; however, corrosion is difficult with various molten salts, and use is possible for a long period of time while immersed.

Oxidation Resistance is Good.

Since bonding is already very strong with oxygen, there is no reaction with oxygen.

Resistance to Build-up is Good.

Resistance with metals is unlikely, so that it is unlikely that metal build-up will be generated on rolls in heat treatment furnaces.

Resistance to Thermal Shock is Good.

It is conjectured that this is because the heat conductivity of the coating film is high; however, there is no peeling with water cooling from 500° C.

Chemical Resistance is Good.

In the ferrous and non-ferrous industries, acid cleaning or alkali cleaning or the like of wires, plates, and the like is conducted; however, in comparison with the structural element single oxides, the thermal spray material in accordance with the present invention is unlikely to be corroded or dissolved. Furthermore, in the paper making industry, the rolls are exposed to such chemicals, as well, so that this is similar, and moreover, the required paper releasing is also good.

Resistance to Sea Water is Good.

Machinery which is employed in sea water or in the spray zone thereof tends to experience corrosion as a result of the sea water. For example, if a coating film of the present invention is applied to a rod of a hydraulic cylinder which is employed in such an environment, it is possible to prevent this corrosion. Furthermore, the sliding characteristics required in such members are also good.

What is claimed is:

1. A member having a coating film formed by thermal spraying of a thermal spray material comprising a double oxide forming monophasic oxide and containing (a) at least one trivalent metal element selected from the group consisting of Al, Ti, V, Cr, Co, Rh, and Sc, Y and lanthanoid in rare earth elements, and (b) at least one element selected from the group consisting of Sc, Y, and lanthanoid in the rare earth elements different from those in (a).

2. A member according to claim 1, wherein said thermal spray material contains two or more kinds of double oxides.

* * * * *